US008872076B2

(12) United States Patent
Suda

(10) Patent No.: US 8,872,076 B2
(45) Date of Patent: Oct. 28, 2014

(54) HEATING DEVICE CAPABLE OF ACCURATELY DETERMINING CHANGE IN STATE, AND IMAGE FORMING APPARATUS

(75) Inventor: Takeyuki Suda, Toride (JP)

(73) Assignee: Canon Kabushiki Kaisha (JP)

( * ) Notice: Subject to any disclaimer, the term of this patent is extended or adjusted under 35 U.S.C. 154(b) by 540 days.

(21) Appl. No.: 13/268,204

(22) Filed: Oct. 7, 2011

(65) Prior Publication Data

US 2012/0085744 A1 Apr. 12, 2012

(30) Foreign Application Priority Data

Oct. 12, 2010 (JP) ..... 2010-229568

(51) Int. Cl.
*H05B 6/06* (2006.01)
*G03G 15/20* (2006.01)
*H05B 6/14* (2006.01)

(52) U.S. Cl.
CPC . *H05B 6/145* (2013.01); *H05B 6/06* (2013.01)
USPC ..... 219/619; 399/33; 399/329

(58) Field of Classification Search
CPC ..... G03G 2215/2041; H05B 6/145
USPC ..... 219/619, 216, 636, 469–471; 399/31, 399/33, 328–329
See application file for complete search history.

(56) References Cited

U.S. PATENT DOCUMENTS

2008/0002996 A1* 1/2008 Ushiro ..... 399/31
2011/0274449 A1* 11/2011 Mine ..... 399/33

FOREIGN PATENT DOCUMENTS

JP 2007-328159 A 12/2007
JP 2008109317 A 5/2008
JP 2009204745 A 9/2009

OTHER PUBLICATIONS

Japanese Office Action in Japanese counterpart application No. JP2010-229568, dated Aug. 19, 2014.

* cited by examiner

*Primary Examiner* — Quang Van
(74) *Attorney, Agent, or Firm* — Rossi, Kimms & McDowell LLP

(57) ABSTRACT

A heating device capable of accurately determining a change in the state of a to-be-heated member, caused in a narrow area. An induction heating coil generates magnetic flux by flow of electric current therethrough. The fixing belt generates heat by the action of the magnetic flux generated by the induction heating coil. A first antenna is disposed at a location where the magnetic flux generated by the induction heating coil can be detected assuming that there is no fixing belt. A second antenna is disposed such that at least some area of the second antenna overlaps the first antenna. A control circuit determines whether or not a state of the fixing belt has changed, based on a result of detection by the first antenna and a result of detection by the second antenna.

8 Claims, 12 Drawing Sheets

AREA A(C)

AREA B

NORMAL TIME V1

NORMAL TIME V2

AREA A-ABNORMAL TIME V1

AREA A-ABNORMAL TIME V2

AREA B-ABNORMAL TIME V1

AREA B-ABNORMAL TIME V2

HEATING DEVICE CAPABLE OF ACCURATELY DETERMINING CHANGE IN STATE, AND IMAGE FORMING APPARATUS

BACKGROUND OF THE INVENTION

1. Field of the Invention

The present invention relates to a heating device for heating a member to be heated, by electromagnetic induction, and an image forming apparatus.

2. Description of the Related Art

Conventionally, there has been known a heating device for heating a member to be heated (hereinafter referred to as "to-be-heated member") by electromagnetic induction. For example, in an image forming apparatus, such as a copying machine or a printer, such a heating device heats a metal roller or a metal belt, which is a to-be-heated member, by electromagnetic induction, and fixes a toner image formed on a sheet using the heat of the heated to-be-heated member.

There has also been known an image forming apparatus of this type, which detects a change in the state of a metal belt as the to-be-heated member, such as a damage, as disclosed in Japanese Patent Laid-Open Publication No. 2007-328159.

FIG. 13 schematically shows a fixing device as a heating device for the image forming apparatus disclosed in Japanese Patent Laid-Open Publication No. 2007-328159. The fixing device has an inlet upper roller 6 and an exit upper roller 7 arranged on upstream and downstream sides, respectively, in a manner spaced from each other. A fixing belt 2, which is an endless metal belt, is wound and stretched between the inlet and exit upper rollers 6 and 7. A nip pad 8 for applying pressure to a sheet, and a temperature-detecting thermistor 4 are arranged inside the fixing belt 2. An inlet lower roller 10 and an exit lower roller 11 are arranged on the upstream and downstream sides, respectively, in a manner spaced from each other, and an endless pressing belt 9 is wound and stretched between the inlet and exit lower rollers 10 and 11. A nip pad 12 is disposed inside the pressing belt 9. An antenna 3 for detecting magnetic flux is disposed inside the fixing belt 2 at a location opposite to an induction heating coil 1 with the fixing belt 2 positioned therebetween. The antenna 3 is connected to an energization inhibition circuit.

The magnetic flux entering the antenna 3 varies depending on the state of the fixing belt 2, and therefore, the image forming apparatus is configured to detect the state of the fixing belt 2 according to the magnetic flux entering the antenna 3 and make the energization inhibition circuit operable to stop the operation of the induction heating coil 1 if there is abnormality in the state of the fixing belt 2.

In the configuration disclosed in Japanese Patent Laid-Open Publication No. 2007-328159, as shown in FIG. 14A, the antenna 3 extends in the direction of width of the fixing belt 2, and by making use of the phenomenon that the amount of magnetic flux entering the antenna 3 is changed by abnormality of the fixing belt 2 from that in a normal state thereof, detects a change in the state of the fixing belt 2, that is, belt abnormality, based on a change in the magnetic flux. Therefore, to detect a belt abnormality which is small when the width of the fixing belt 2 is considered, it is required to set a small reference threshold value for determining the belt is abnormal.

However, even if the fixing belt 2 is in the normal state, the amount of magnetic flux entering the antenna 3 does not become equal to 0, and moreover even when the fixing belt 2 is normal, the amount of magnetic flux entering the antenna 3 varies with the strength of induction heating or the like. Therefore, to prevent the fixing belt 2 in the normal state from being erroneously detected to be abnormal, it is necessary to set a higher threshold value. This brings about the problem that it is difficult to detect a belt abnormality occurring in a narrow range.

To solve such a problem, the present assignee has studied a configuration shown in FIG. 14B in which the antenna is twisted at a central portion in an extending direction thereof, and inverts the polarity of output, to thereby cause generated voltages to cancel each other out. According to this configuration, it is considered that the amount of magnetic flux entering the antenna 3 increases only in an area where abnormality of the fixing belt 2 has occurred, whereby even a relatively small abnormality can be detected.

However, as shown in FIG. 14A, it is also assumed that belt abnormality occurs in an area X which is within a range equidistant from the central position of the antenna 3 in the extending direction of the antenna 3. In such a case, no difference is caused in the amount of magnetic flux entering the antenna 3 between the back side (upper portion in FIG. 14A) and the front side (lower portion in FIG. 14A) of the antenna 3, whereby it is predicted that abnormality of the fixing belt 2 cannot be detected. More specifically, in the case where the antenna configuration shown in FIG. 14B is employed, it is difficult to detect a belt abnormality which occurs in an area extending equally in opposite directions along the width of the belt from the central portion of the antenna 3 on opposite sides of which the polarity is inverted therebetween, which adversely affects the accuracy of belt abnormality detection.

SUMMARY OF THE INVENTION

The present invention provides a heating device and an image forming apparatus which are capable of accurately determining a change in the state of a to-be-heated member, occurring in a narrow area.

In a first aspect of the present invention, there is provided a heating device comprising a coil that generates magnetic flux by flow of electric current therethrough, a to-be-heated member configured to generate heat by action of the magnetic flux generated by the coil, a first magnetic flux-detecting unit disposed at a location where the first magnetic flux-detecting unit is capable of detecting the magnetic flux generated by the coil assuming that the to-be-heated member does not exist, a second magnetic flux-detecting unit disposed such that at least some area of the second magnetic flux-detecting unit overlaps the first magnetic flux-detecting unit, and a control unit configured to determine whether or not a state of the to-be-heated member has changed, based on a result of detection by the first magnetic flux-detecting unit and a result of detection by the second magnetic flux-detecting unit, wherein the first magnetic flux-detecting unit includes at least one polarity inverting portion as a boundary on opposite sides of which a polarity of output is inverted therebetween, and wherein the second magnetic flux-detecting unit includes a polarity inverting portion as a boundary at which on opposite sides of which a polarity of output is inverted therebetween, provided at a position that is not coincident with a position of the polarity inverting portion of the first magnetic flux-detecting unit.

In a second aspect of the present invention, there is provided a heating device comprising a coil that generates magnetic flux by flow of electric current therethrough, a to-be-heated member configured to generate heat by action of the magnetic flux generated by the coil, a first magnetic flux-detecting unit disposed at a location where the first magnetic flux-detecting unit is capable of detecting the magnetic flux generated by the coil assuming that the to-be-heated member does not exist, a second magnetic flux-detecting unit disposed such that at least some area of the second magnetic flux-detecting unit overlaps the first magnetic flux-detecting unit, and a control unit configured to determine whether or not a state of the to-be-heated member has changed, based on a result of detection by the first magnetic flux-detecting unit and a result of detection by the second magnetic flux-detecting unit, wherein the first magnetic flux-detecting unit includes at least one polarity inverting portion as a boundary on opposite sides of which a polarity of output is inverted therebetween, and wherein the second magnetic flux-detecting unit includes no polarity inverting portion as a boundary on opposite sides of which a polarity of output is inverted therebetween, and is disposed at a position where the second magnetic flux-detecting unit is capable of detecting the magnetic flux at a position of the polarity inverting portion of the first magnetic flux-detecting unit.

In a third aspect of the present invention, there is provided an image forming apparatus comprising a transfer unit configured to transfer a toner image onto a recording medium, a coil that generates magnetic flux by flow of electric current therethrough, a fixing belt configured to generate heat by action of the magnetic flux generated by the coil, to thereby heat the toner image transferred onto the recording medium, a first magnetic flux-detecting unit disposed at a location where the first magnetic flux-detecting unit is capable of detecting the magnetic flux generated by the coil assuming that the fixing belt does not exist, a second magnetic flux-detecting unit disposed such that at least some area of the second magnetic flux-detecting unit overlaps the first magnetic flux-detecting unit; and a control unit configured to determine whether or not a state of the fixing belt has changed, based on a result of detection by the first magnetic flux-detecting unit and a result of detection by the second magnetic flux-detecting unit, wherein the first magnetic flux-detecting unit includes at least one polarity inverting portion as a boundary on opposite sides of which a polarity of output is inverted therebetween, and wherein the second magnetic flux-detecting unit includes a polarity inverting portion as a boundary on opposite sides of which a polarity of output is inverted therebetween, provided at a position that is not coincident with a position of the polarity inverting portion of the first magnetic flux-detecting unit.

In a fourth aspect of the present invention, there is provided an image forming apparatus comprising a transfer unit configured to transfer a toner image onto a recording medium, a coil that generates magnetic flux by flow of electric current therethrough, a fixing belt configured to generate heat by action of the magnetic flux generated by the coil, to thereby heat the toner image transferred onto the recording medium, a first magnetic flux-detecting unit disposed at a location where the first magnetic flux-detecting unit is capable of detecting the magnetic flux generated by the coil can be detected assuming that the fixing belt does not exist, a second magnetic flux-detecting unit disposed such that at least some area of the second magnetic flux-detecting unit overlaps the first magnetic flux-detecting unit, and a control unit configured to determine whether or not a state of fixing belt has changed, based on a result of detection by the first magnetic flux-detecting unit and a result of detection by the second magnetic flux-detecting unit, wherein the first magnetic flux-detecting unit includes at least one polarity inverting portion as a boundary on opposite sides of which a polarity of output is inverted therebetween, and wherein the second magnetic flux-detecting unit includes no polarity inverting portion as a boundary on opposite sides of which a polarity of output is inverted therebetween, and is disposed at a position where the second magnetic flux-detecting unit is capable of detecting the magnetic flux at a position of the polarity inverting portion of the first magnetic flux-detecting unit.

According to the present invention, it is possible to accurately determine a change in the state of a to-be-heated member, occurring in a narrow area.

The features and advantages of the invention will become more apparent from the following detailed description taken in conjunction with the accompanying drawings.

DESCRIPTION OF THE EMBODIMENTS

The present invention will now be described in detail below with reference to the accompanying drawings showing embodiments thereof.

Figure 1:
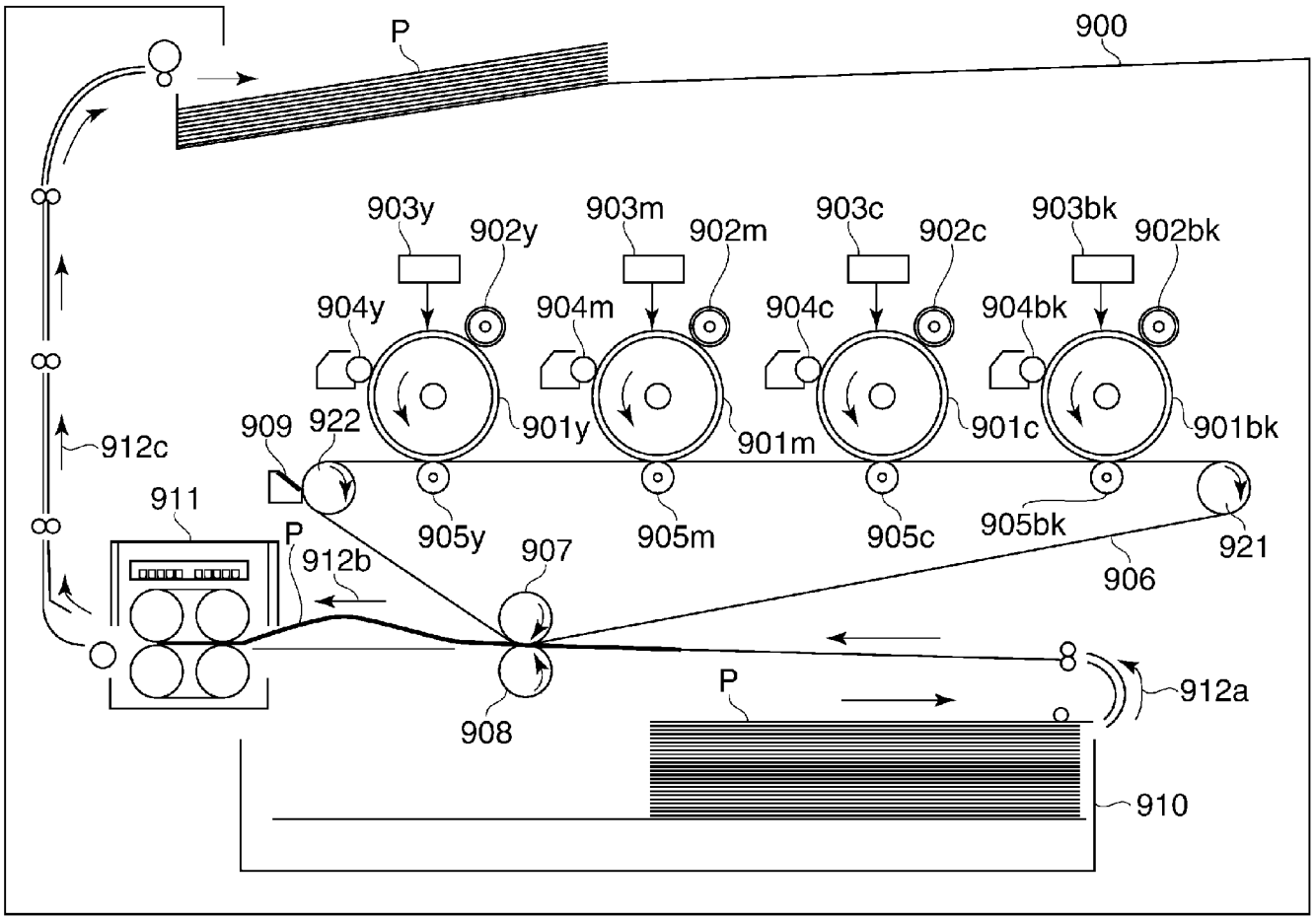
FIG. 1 is a schematic diagram of the whole arrangement of an image forming apparatus to which is applied a heating device according to an embodiment of the present invention.

FIG. 1 is a diagram of a whole image forming apparatus to which is applied a heating device according to an embodiment of the present invention.

The image forming apparatus, denoted by reference numeral 900, is configured as an electrophotographic full-color printer including a fixing unit 911 as a heating device, by way of example.

The image forming apparatus 900 includes image forming units of four colors, arranged in a tandem manner from left to right, as viewed in FIG. 1. The image forming units are each an electrophotographic processing mechanism based on a laser exposure method, and have the same configuration. Component elements associated with yellow, magenta, cyan, and black are denoted by symbols "y", "m", "c", and "bk", respectively.

Now, a description will be given of a yellow image forming unit. In the image forming apparatus 900, a charging roller 902*y* charges a photosensitive drum 901*y* to a predetermined potential, to thereby smooth the potential of the photosensitive drum 901*y*. The photosensitive drum 901*y* rotates counterclockwise, as viewed in FIG. 1, and a laser unit 903*y* scans the surface of the photosensitive drum 901*y* by laser beam, and forms an electrostatic latent image on the surface thereof.

Further, an intermediate transfer belt 906 is wound and stretched between a driving roller 921, a driven roller 922, and a secondary transfer roller 907, and is driven for clockwise rotation, as viewed in FIG. 1. A primary transfer charging roller 905*y* is disposed on the reverse side of the intermediate transfer belt 906. According to the electrostatic latent image formed on the surface of the photosensitive drum 901*y*, toner is attached to the photosensitive drum 901*y* by a development blade 904*y*. At this time, the toner image attached to the photosensitive drum 901*y* matches an image drawn as the electrostatic latent image. After the photosensitive drum 901*y* further rotates, the toner image is transferred onto the intermediate transfer belt 906. The other image forming units each have the same arrangement as the yellow image forming unit, and hence descriptions thereof are omitted.

The four-color toner image attached to the intermediate transfer belt 906 is transferred onto a sheet P, which is a recording medium conveyed from a sheet cassette 910 via a sheet conveying path 912*a*, by the secondary transfer roller 907 and a secondary-transfer opposed roller 908. Toner remaining on the intermediate transfer belt 906 without being transferred onto the sheet P is removed by a cleaning unit 909.

The sheet P having the toner image attached thereto is conveyed to the fixing unit 911 via a sheet conveying path 912*b*, and the toner image, which is unfixed, is fixed on the sheet P by heat and pressure. The sheet P having the toner image fixed thereon is discharged via a sheet conveying path 912*c* as a product.

Figure 2:
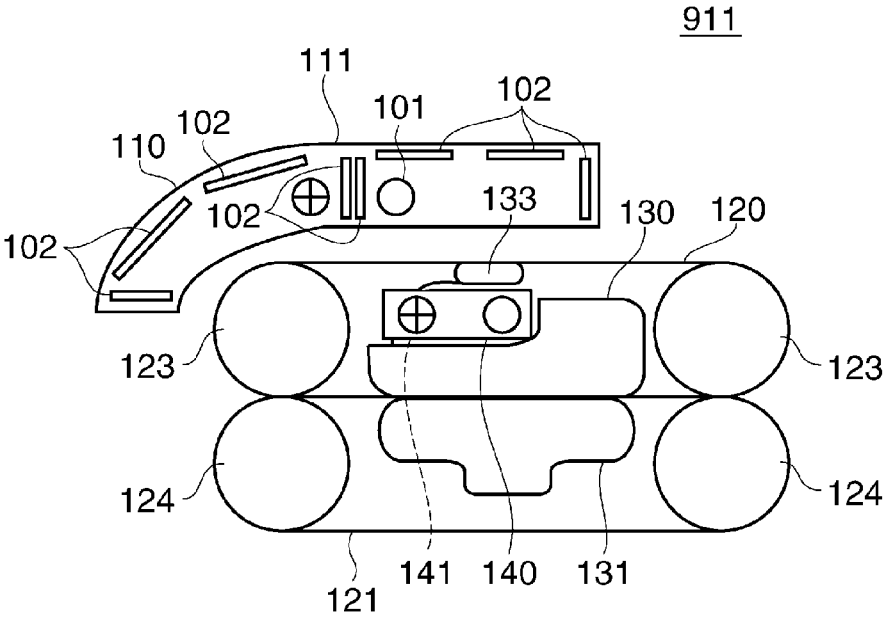
FIG. 2 is a schematic diagram of a fixing unit.

Next, a description will be given of the arrangement of the fixing unit 911. FIG. 2 schematically shows the fixing unit 911. The left side, as viewed in FIG. 2, is the downstream side of a flow of the sheet P.

In the fixing unit 911, an upper fixing belt 120, which is an endless to-be-heated member, is wound and stretched between two core metals 123 such that the fixing belt 120 is rotated by rotations of the core metals 123. The fixing belt 120 is made of metal, and is heated by a so-called electromagnetic induction heating method, in which heat is generated by an eddy current caused to flow by the action of an alternating magnetic flux generated by an induction heating coil 101. More specifically, the fixing belt 120 has a rubber layer formed on the front side of a conductive layer made of metal, and heat is generated by the eddy current flowing through the conductive layer. A material which has a high relative permeability and hence is highly permeable to magnetic flux is selected for the conductive layer of the fixing belt 120.

Further, a lower fixing belt 121, which is an endless pressing belt, is wound and stretched between two core metals 124 such that the fixing belt 121 is rotated by rotations of the core metals 124. The sheet P having the unfixed toner image attached thereto passes between the two fixing belts 120 and 121, whereby the unfixed toner image is fixed.

Nip pads 130 and 131, which are metal plates for applying pressure to the sheet P, are arranged inside the upper and lower fixing belts 120 and 121, respectively, whereby spaces inside the upper and lower fixing belts 120 and 121 are narrowed. Further, a thermistor 133 is disposed inside the upper fixing belt 120, and measures the temperature of the upper fixing belt 120. Further, a first antenna (first magnetic flux-detecting unit) 140 and a second antenna (second magnetic flux-detecting unit) 141, which are two loop antennas (hereinafter simply referred to as the "antennas"), are arranged inside the upper fixing belt 120.

Each of the first and second antennas 140 and 141 extends parallel to the direction of width of the fixing belt 120 (direction of depth as viewed in FIG. 2), and is disposed in a manner such that an electric wire goes and returns along the extending direction of the antenna to form a generally annular shape (form a loop) longer in the extending direction. The second antenna 141 is located on the reverse side of the first antenna 140 (on the back side as viewed in FIG. 2), and is hidden in FIG. 2. The first and second antennas 140 and 141 are configured to generate voltage or current by magnetic flux, and in the present embodiment, each used for detecting magnetic flux by an output voltage therefrom. The basic construction of each of the first and second antennas 140 and 141 is the same as the antenna disclosed in Japanese Patent Laid-Open Publication No. 2007-328159. The arrangement of the first and second antennas 140 and 141, including the positional relationship therebetween and shapes thereof, will be described in detail hereinafter with reference to FIGS. 7A and 7B.

A heating coil unit 110 is disposed close to an upper portion of the fixing belt 120. The heating coil unit 110 comprises the induction heating coil 101, ferrite cores 102, which are magnetic bodies, and a casing 111 for supporting the whole heating coil unit 110. The induction heating coil 101 is designed such that magnetic flux generated by the same passes through magnetic paths mainly formed by the ferrite cores 102 and the fixing belt 120.

Figure 3:
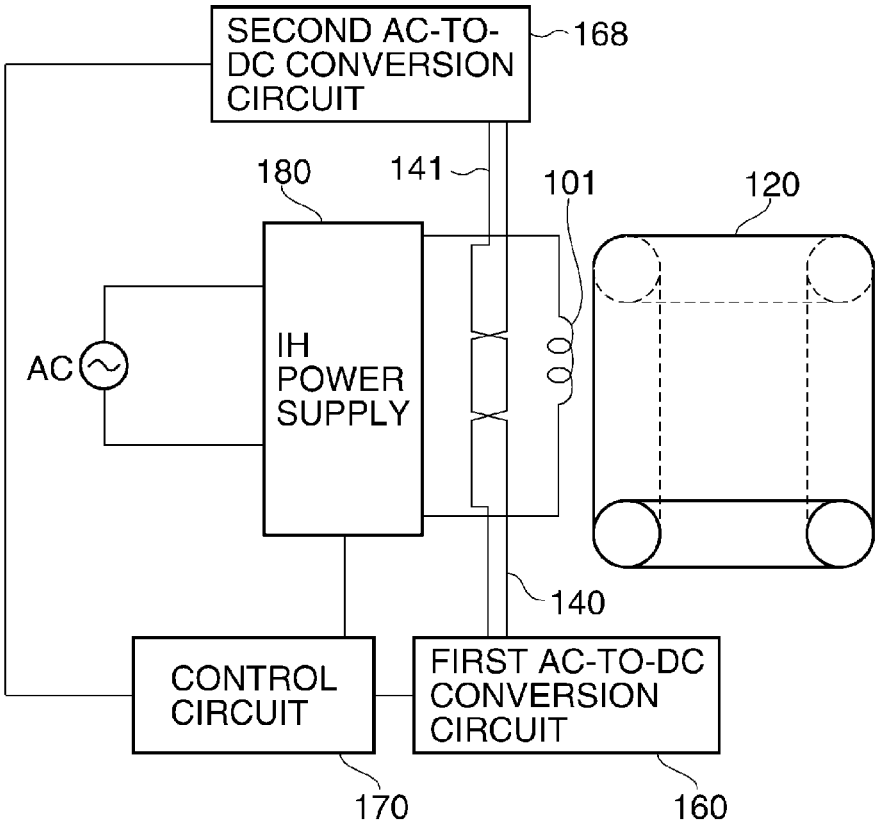
FIG. 3 is a block diagram of a control mechanism of the fixing unit.

FIG. 3 is a block diagram of a control mechanism of the fixing unit 911. Output voltages from the first and second antennas 140 and 141 are delivered to a control circuit (control unit) 170 via a first AC-to-DC conversion circuit 160 and a second AC-to-DC conversion circuit 168, respectively. The control circuit 170 controls the operation of an IH (induction heating) power supply 180 such that it can start and stop the IH power supply 180. The IH power supply 180 is controlled as above to thereby drivingly control the induction heating coil 101. The control circuit 170 comprises a CPU, not shown, an ASIC (application-specific integrated circuit), not shown, and so forth, and controls the overall operation of the fixing unit 911.

Figure 4:
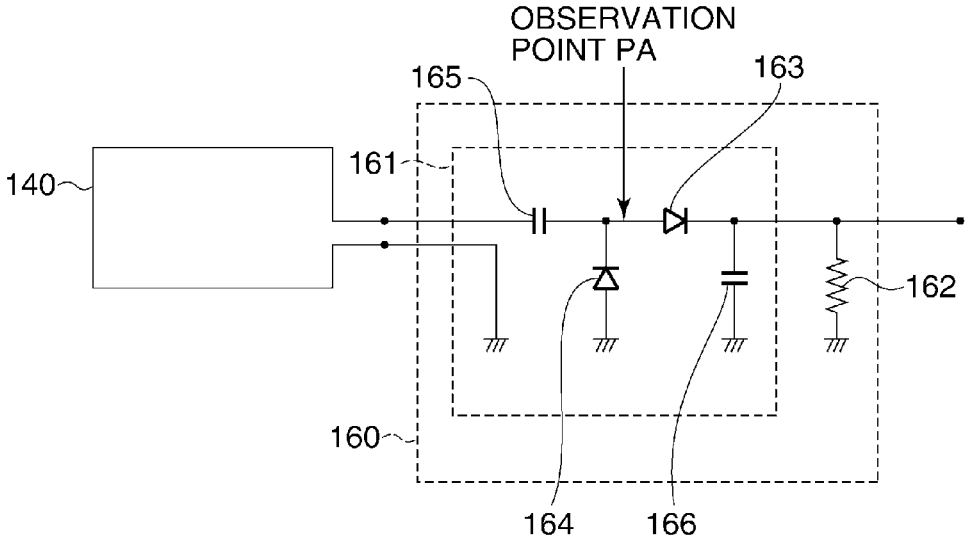
FIG. 4 is a first circuit diagram of an AC-to-DC conversion circuit.

FIG. 4 is a circuit diagram of the first AC-to-DC conversion circuit 160. An output from the first AC-to-DC conversion circuit 160 is proportional to the output voltage from the first antenna 140, and hence based on the output from the first AC-to-DC conversion circuit 160, it is possible to know the level of voltage generated by the first antenna 140. The waveform of the voltage generated by the first antenna 140 is similar to a waveform of the differentiation of magnetic flux entering the first antenna 140, and the magnetic flux entering the first antenna 140 is generated by electric current flowing through the induction heating coil 101. Since the alternating magnetic flux is generated by the induction heating coil 101, the basic frequency of the waveform of the voltage generated by the first antenna 140 is the same as the basic frequency of an AC current flowing through the induction heating coil 101, and is approximately 20 KHz to 80 KHz.

Figure 5A:
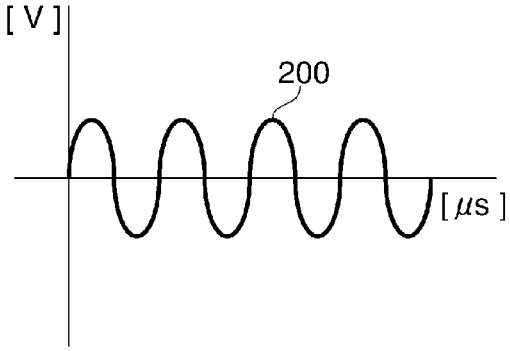
FIGS. 5A to 5C are views showing a waveform of an output from an antenna, a waveform of an output from the AC-to-DC conversion circuit, and a DC waveform, respectively.
Figure 5B:
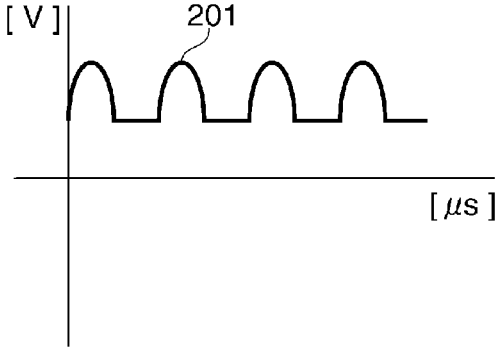
Figure 5C:
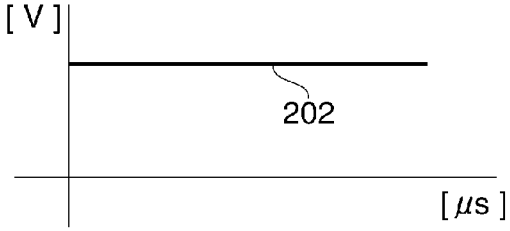

FIGS. 5A to 5C show the waveform of an output from the first antenna 140, a waveform of the output from the first AC-to-DC conversion circuit 160, and a DC waveform, respectively. Hereinafter, the operation and waveform of the first AC-to-DC conversion circuit 160 will be described with reference to FIG. 4 and FIGS. 5A to 5C.

The first AC-to-DC conversion circuit 160 converts a high-frequency AC voltage 200 generated by the first antenna 140 (FIG. 5A) to a DC voltage 202 (FIG. 5C), for outputting the same. To this end, in the present embodiment, there is employed a voltage doubler rectifier circuit 161 which includes diodes 163 and 164, and capacitors 165 and 166 (FIG. 4).

At an observation point PA of the voltage doubler rectifier circuit 161 shown in FIG. 4, a waveform 201 (FIG. 5B) is observed, and the output signal has the DC voltage 202 (FIG. 5C). Further, the voltage doubler rectifier circuit 161 can be provided with a resistance 162 for adjusting discharge current, so as to change the drop rate of the DC voltage 202, as desired. As described above, it is possible to know the level of voltage output from the first antenna 140 based on an output signal from the first AC-to-DC conversion circuit 160.

The relationship between the second AC-to-DC conversion circuit 168 and the second antenna 141 and the arrangement thereof are the same as the relationship between the first AC-to-DC conversion circuit 160 and the first antenna 140 and the arrangement thereof, described above with reference to FIG. 4 and FIGS. 5A to 5C, and hence description thereof is omitted.

Figure 6A:
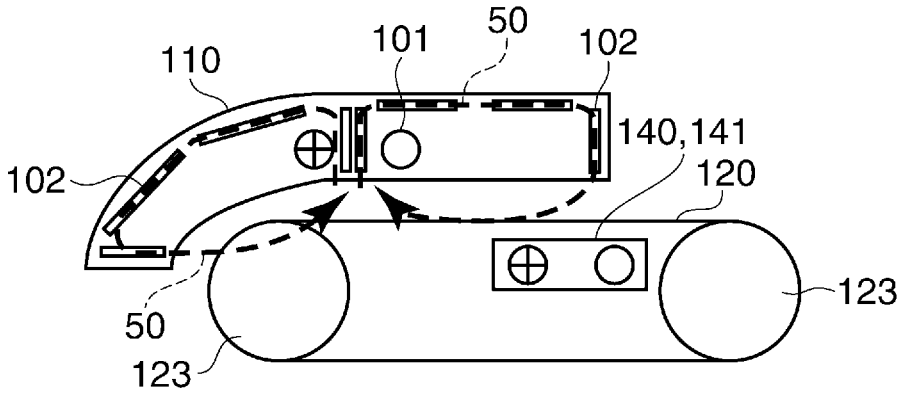
FIGS. 6A and 6B are views showing magnetic paths formed when a fixing belt is normal and when the same is abnormal, respectively.
Figure 6B:
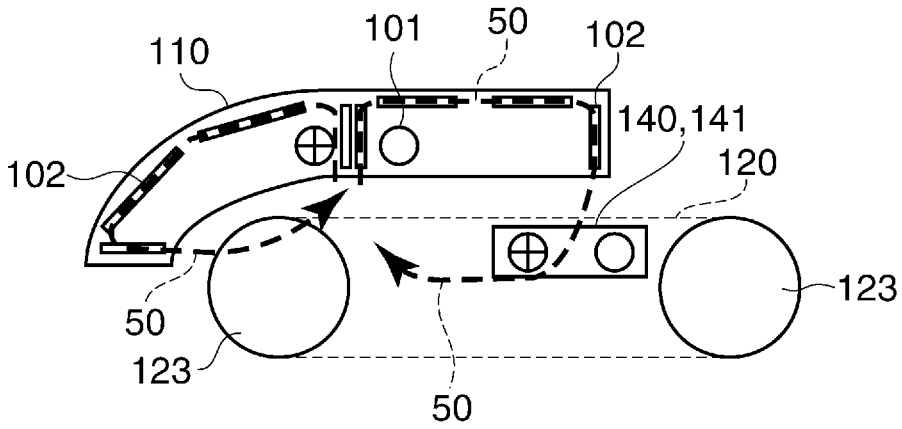

FIGS. 6A and 6B show magnetic paths formed when the fixing belt 120 is normal and when the same is abnormal, respectively. Now, the phrase "when the fixing belt 120 is abnormal" is intended to mean "when the state of the fixing belt 120 has changed from a normal state thereof". The phrase is intended to mean, for example, "when the fixing belt 120 suffers from damage (belt abnormality), such as breakage and peeling. In FIGS. 6A and 6B, component parts inside the fixing belt 121 and the fixing belt 120 are omitted from illustration.

As shown in FIG. 6A, when the fixing belt 120 is normal, much of magnetic flux generated by the induction heating coil 101 flows to pass through magnetic paths formed by the ferrite cores 102 and the fixing belt 120. Magnetic flux flowing through the ferrite cores 102 is referred to as the "magnetic flux 50".

In the fixing belt 120, when an eddy current flows, Joule heat is generated to thereby generate heat, and at the same time the fixing belt 120 as well serves as a magnetic path since the fixing belt 120 itself is made of a material having a high magnetic permeability. Therefore, when the fixing belt 120 is normal, the magnetic flux 50 passes through the fixing belt 120, whereas when the fixing belt 120 suffers from abnormality, such as a breakage, as shown in FIG. 6B, in an area where the abnormality has occurred, a change is caused in an associated path through which the magnetic flux 50 passes. That is, the magnetic flux 50 comes to pass through the first and second antennas 140 and 141 through which the magnetic flux 50 hardly passes when the fixing belt 120 is normal.

From the above, when abnormality of the fixing belt 120, such as partial breakage thereof, is caused, the magnetic flux 50 passing through the first and second antennas 140 and 141 generates voltages at the opposite ends of the respective antennas 140 and 141, in a manner dependent on a location where the belt abnormality has occurred and the degree of the belt abnormality. This makes it possible to detect the abnormality of the fixing belt 120 based on the levels of the voltages.

Figure 7A:
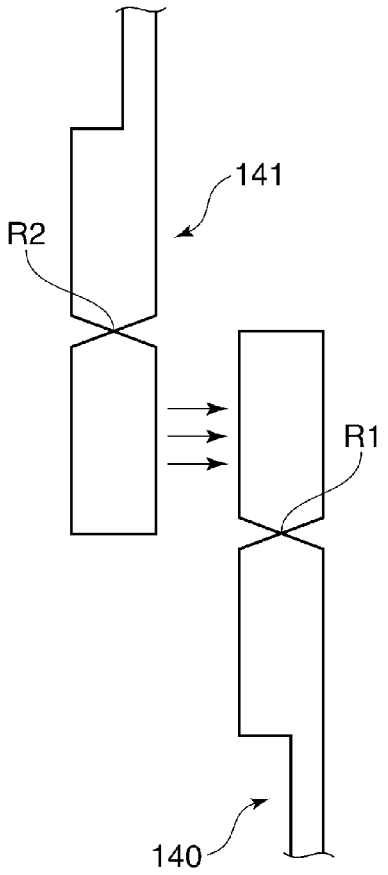
FIG. 7A is a view of first and second antennas in a separate state.
Figure 7B:
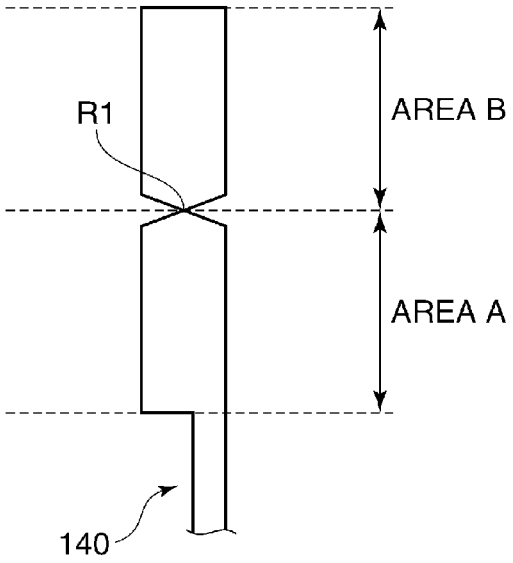
FIG. 7B is a plan view of the first antenna, as viewed from above.
Figure 8:
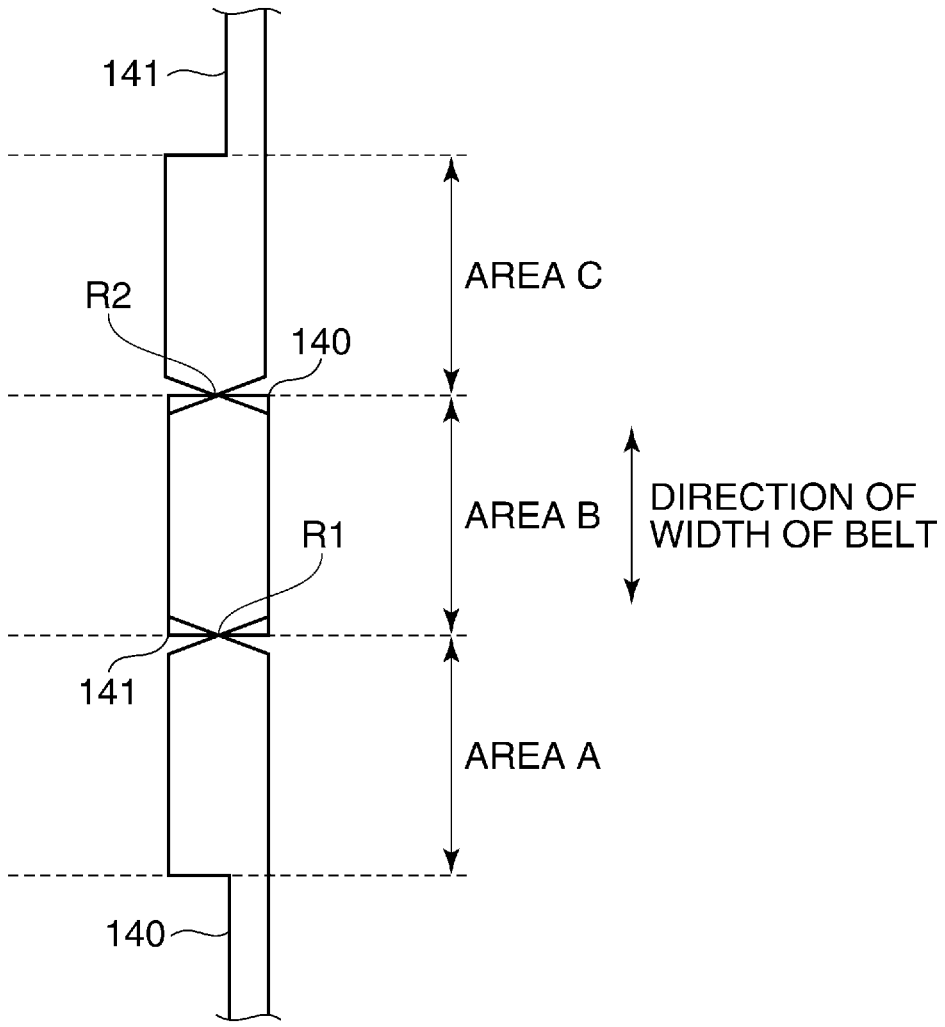
FIG. 8 is a plan view of the first and second antennas in a state overlapping each other.

Next, a description will be given of the manner of the arrangement of the first and second antennas 140 and 141 and the shapes thereof. FIG. 7A shows the first and second antennas 140 and 141 in a separate state, and FIG. 7B is a plan view of the first antenna 140, as viewed from above. FIG. 8 is a plan view of the first and second antennas 140 and 141 in a state overlapping each other. Each of FIGS. 7A and 7B and FIG. 8 schematically shows the first and second antennas 140 and 141, and the proportion of the actual sizes thereof is not limited to the illustrated one. In FIGS. 7A and 7B and FIG. 8, the vertical direction is the direction of the width of the fixing belt 120, the upper side corresponds to the back side as viewed in FIGS. 1, 2, 6A, and 6B, and the lower side corresponds to the front side as viewed in FIGS. 1, 2, 6A, and 6B.

Each of the first and second antennas 140 and 141 is formed by arranging electric wire along an extending direction thereof in a go-and-return manner. The electric wire is twisted at intermediate portions thereof in the extending direction such that go and return lines thereof intersect each other, whereby a polarity inverting portion R is provided as a boundary on opposite sides of which the polarity of output is inverted therebetween, thus forming a so-called 8-shaped winding. In the case of the first antenna 140, as shown in FIGS. 7A and 7B, a polarity inverting portion R1 is formed just in a central position of the first antenna 140 in the extending direction thereof. Similarly, also in the second antenna 141, as shown in FIG. 7A, a polarity inverting portion R2 is formed just in a central position of the second antenna 141 in the extending direction thereof.

As shown in FIGS. 6A and 6B, the first and second antennas 140 and 141 are each arranged in parallel to an inner surface of an upper stretch of the fixing belt 120, at a location close and opposite to the inner surface. As shown in FIG. 8, the first and second antennas 140 and 141 are arranged such that they are parallel to each other in the extending direction thereof and overlap each other at least in some area. The longitudinal directions of the first and second antennas 140 and 141 are along the direction of the width of the fixing belt 120. The fixing belt 120 passes over the first and second antennas 140 and 141. The constructions of the first and second antennas 140 and 141 and the locations where they are arranged are substantially symmetrical with respect to the center of the fixing belt 120 in the direction of the width of the fixing belt 120. The first and second antennas 140 and 141 are arranged such that they vertically overlap each other. Each of the first and second antennas 140 and 141 is capable of detecting magnetic flux passing therethrough.

The total of areas A, B, and C corresponds to the whole area of the fixing belt 120 in the direction of the width thereof. The lengths of extension of the first and second antennas 140 and 141 are shorter than the length of the whole area of the fixing belt 120 in the direction of the width thereof, and are approximately equal to two thirds of the length of the whole area. The first antenna 140 is disposed over the areas A and B which are adjacent to each other, while the second antenna 141 is disposed over the areas B and C which are adjacent to each other. The positions of the polarity inverting portions R1 and R2 are not coincident with each other in the extending direction of the first and second antennas 140 and 141.

More specifically, the first antenna 140 extends such that the back-side end thereof comes up to the position of the polarity inverting portion R2 of the second antenna 141, and the second antenna 141 extends such that the front-side end thereof comes up to the position of the polarity inverting portion R1 of the first antenna 140. The first and second antennas 140 and 141 overlap each other in the area B. This enables detection of magnetic flux in the area A to be performed mainly by the first antenna 140, detection of magnetic flux in the area B to be performed by both the first and second antennas 140 and 141, and detection of magnetic flux in the area C to be performed mainly by the second antenna 141.

Figure 9A:
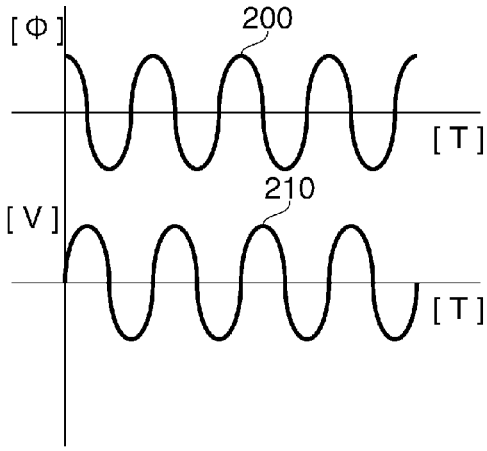
FIGS. 9A and 9B are views of relationships in the waveform of entering magnetic flux and the waveform of an output voltage in respective areas of the first antenna.
Figure 9B:
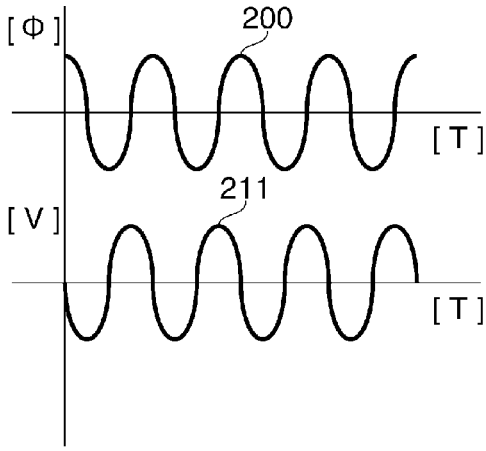

FIGS. 9A and 9B are views of relationships in the waveform of entering magnetic flux and the waveform of an output voltage in respective areas A and B of the first antenna 140. In each of FIGS. 9A and 9B, the upper line represents a waveform [ϕ] of magnetic flux, and the lower line represents a waveform [V] of an output voltage. Since the relationship between the waveform of magnetic flux entering the area C of the second antenna 141 and the waveform of an output voltage therefrom, and the relationship between the waveform of magnetic flux entering the area B of the second antenna 141 and the waveform of an output voltage therefrom are the same as in the case of the first antenna 140, a description will be given only of the case of the first antenna 140.

First, a voltage generated by the first antenna 140 corresponds to a differential value of magnetic flux. Therefore, if the amplitude of an alternating magnetic flux entering the first antenna 140 becomes larger, the differential value of the magnetic flux also becomes larger, and hence the voltage generated by the first antenna 140 becomes larger. Here, let it be assumed that the same magnetic flux entering the areas A and B (FIG. 7B) of the first antenna 140 has a waveform 220, as shown in FIGS. 9A and 9B. In this case, however, the polarity of output is inverted between opposite sides of the boundary of the polarity inverting portion R1, and therefore voltage waveforms 210 and 211 in the respective areas A and B become opposite in phase to each other (displaced in phase by 180°).

When the fixing belt 120 is normal, a very small amount of magnetic flux enters all the areas of the first antenna 140, and the first antenna 140 does not output voltage. More specifically, if magnetic flux uniformly enters all the areas of the first antenna 140, voltage waveforms output by the magnetic flux entering the areas A and B become opposite to each other in phase, thereby canceling each other, so that the first antenna 140 does not output voltage regardless of the strength of the magnetic flux.

On the other hand, when belt abnormality of the fixing belt 120 has occurred only in the area A of the first antenna 140, more magnetic flux enters the area A than the area B, which causes an imbalance of generated electromotive voltages between the areas A and B. This will make the amplitude of the voltage waveform shown in FIG. 9A larger than that of the voltage waveform shown in FIG. 9B, so that the voltage waveforms of opposite phases, output by the magnetic flux entering the areas A and B, cease to completely cancel each other. As a consequence, the first antenna 140 outputs a voltage corresponding to the difference between the output voltage waveforms. Similarly, also when belt abnormality has occurred only in the area B of the first antenna 140, a voltage corresponding to the difference between output voltage waveforms is output.

Next, a description will be given of a method in which the control circuit 170 determines whether or not the state of the fixing belt 120 has changed, based on the results of detection by the first and second antennas 140 and 141 (process for determining abnormality of the fixing belt).

Figure 10A:
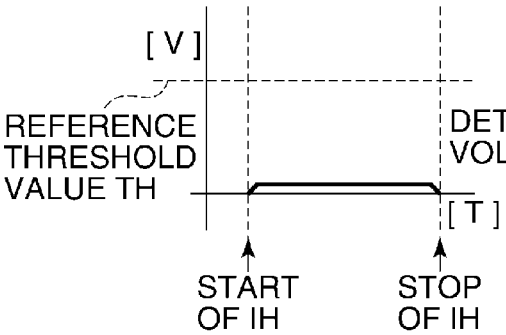
FIGS. 10A and 10B are views showing respective waveforms of outputs from a first AC-to-DC conversion circuit and a second AC-to-DC conversion circuit when the fixing belt is normal.
Figure 10B:
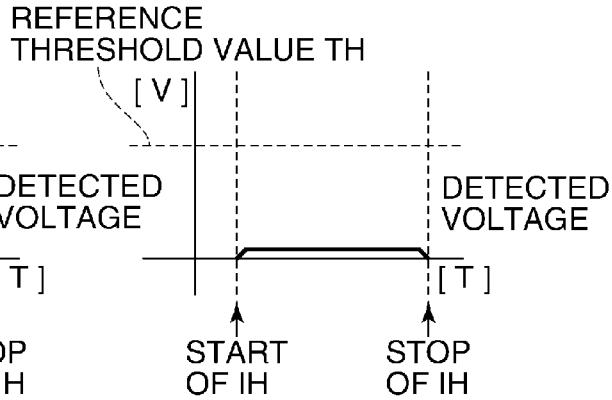
Figure 10C:
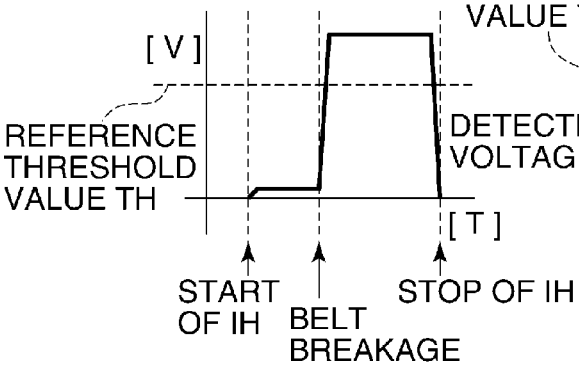
FIGS. 10C to 10F are views showing respective waveforms of outputs from the first and second AC-to-DC conversion circuits when the fixing belt is abnormal in some area of the first antenna.
Figure 10D:
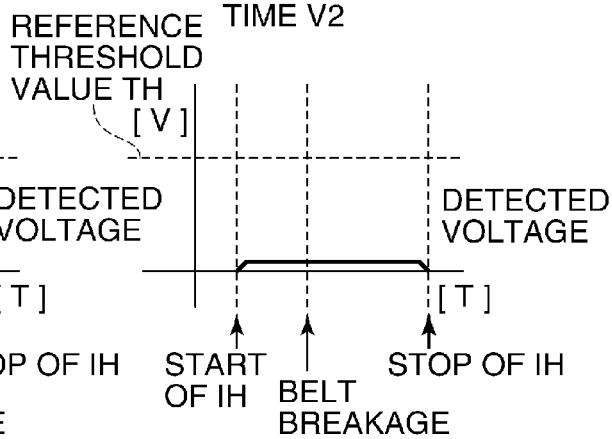
Figure 10E:
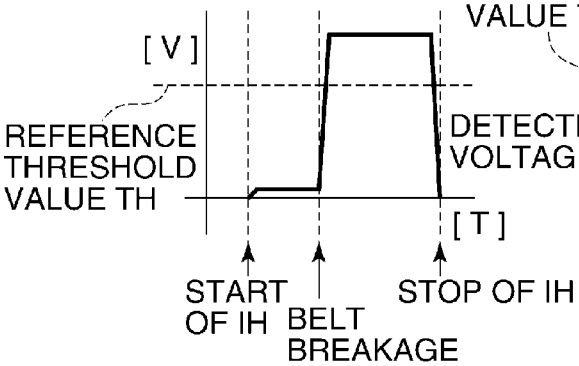
Figure 10F:
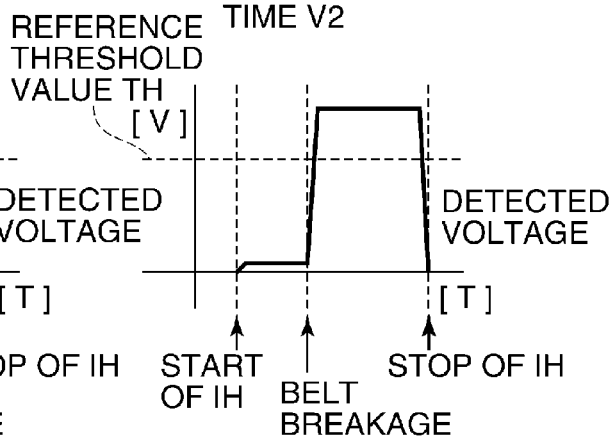

FIGS. 10A and 10B show waveforms of the outputs from the first AC-to-DC conversion circuit 160 and the second AC-to-DC conversion circuit 168 when the fixing belt 120 is normal, respectively. FIGS. 10C and 10D show waveforms of the outputs from the first AC-to-DC conversion circuit 160 and the second AC-to-DC conversion circuit 168 when the fixing belt 120 is abnormal in the area A, respectively. FIGS. 10E and 10F show waveforms of the outputs from the first and second AC-to-DC conversion circuits 160 and 168 when the fixing belt 120 is abnormal in the area B, respectively.

As shown in FIGS. 10A and 10B, when induction heating is started at a certain time point (IH start), outputs V1 and V2 from the respective first and second AC-to-DC conversion circuits 160 and 168 (detected voltages) rise slightly and then are held almost constant. The values of the outputs do not exceed a reference threshold value TH until the induction heating is stopped.

Next, a case is considered where some abnormality (breakage or the like) of the fixing belt 120 occurs only in the area A during operation of the induction heating. As shown in FIG. 10C, the output V1 from the first AC-to-DC conversion circuit 160 is the same as the output V1 shown in FIG. 10A and is smaller than the reference threshold value TH, until the occurrence of the abnormality. However, after a time point of occurrence of the abnormality, the output V1 suddenly rises to exceed the reference threshold value TH. This state continues until the induction heating is stopped. On the other hand, since no abnormality has occurred in the areas B and C, the output V2 from the second AC-to-DC conversion circuit 168 does not change before and after occurrence of the belt abnormality, and does not exceed the reference threshold value TH (FIG. 10D).

Further, if some abnormality of the fixing belt 120 occurs only in the area B, both the output V1 from the first AC-to-DC conversion circuit 160 and the output V2 from the second AC-to-DC conversion circuit 168 come to exceed the reference threshold value TH after a time point of occurrence of the abnormality (FIGS. 10E and 10F).

On the other hand, if some abnormality of the fixing belt 120 occurs only in the area C, the relationship between the outputs V1 and V2 becomes opposite to the relationship shown in FIGS. 10C and 10D. More specifically, although not shown, the output V2 from the second AC-to-DC conversion circuit 168 exceeds the reference threshold value TH after a time point of occurrence of the abnormality, whereas the output V1 from the first AC-to-DC conversion circuit 160 does not exceed the reference threshold value TH without any change before and after the occurrence of the belt abnormality.

Therefore, the control circuit 170 can determine whether or not the state of the fixing belt 120 has changed, by monitoring the outputs V1 and V2 from the respective first and second AC-to-DC conversion circuits 160 and 168 and comparing the outputs with the reference threshold value TH. In this case, it is possible to determine that the fixing belt 120 suffers from belt abnormality when at least one of the outputs V1 and V2 has exceeded the reference threshold value TH.

By the way, a case can also be assumed where belt abnormality occurs in an area having a certain width and extending equally in opposite directions from a boundary between the area A and the area B (just from the position of the polarity inverting portion R1) along the width of the fixing belt 120. In this case, in the first antenna 140, since a balance between magnetic flux entering the area A and magnetic flux entering the area B is held, little or no voltage is output from the first AC-to-DC conversion circuit 160. This is because in the first antenna 140, the levels of alternating magnetic fluxes entering the areas A and B become equal to each other, and voltages, which correspond to the differential values of the alternating magnetic fluxes, are generated with the same amplitude and at the same time in the state of the phases thereof being displaced by 180°, whereby the waveforms of the voltages cancel each other.

In this case as well, however, the second antenna 141 can detect part of the magnetic flux entering the area B in the vicinity of an end thereof in its extending direction, so that the output V2 from the second AC-to-DC conversion circuit 168 becomes larger than when the fixing belt 120 is normal. If the level of the output V2 exceeds the reference threshold value TH, it is possible to detect the belt abnormality. Inversely, in a case where belt abnormality occurs in an area having a certain width and extending equally in opposite directions from a boundary between the area B and the area C (just from the position of the polarity inverting portion R2) along the width of the fixing belt 120, the second antenna 141 cannot detect the belt abnormality, but the output V1 from the first AC-to-DC conversion circuit 160 becomes larger than when the fixing belt 120 is normal, whereby the second antenna 140 can detect the belt abnormality.

Therefore, in checking the states of all the areas A, B, and C of the first antenna 140, including the boundaries between the areas, if at least one of the outputs V1 and V2 exceeds the reference threshold value TH, it is possible to determine that the belt abnormality has occurred. This makes it possible to detect the belt abnormality that occurs in the fixing belt 120, in a manner covering the whole area of the fixing belt 120.

Figure 11:
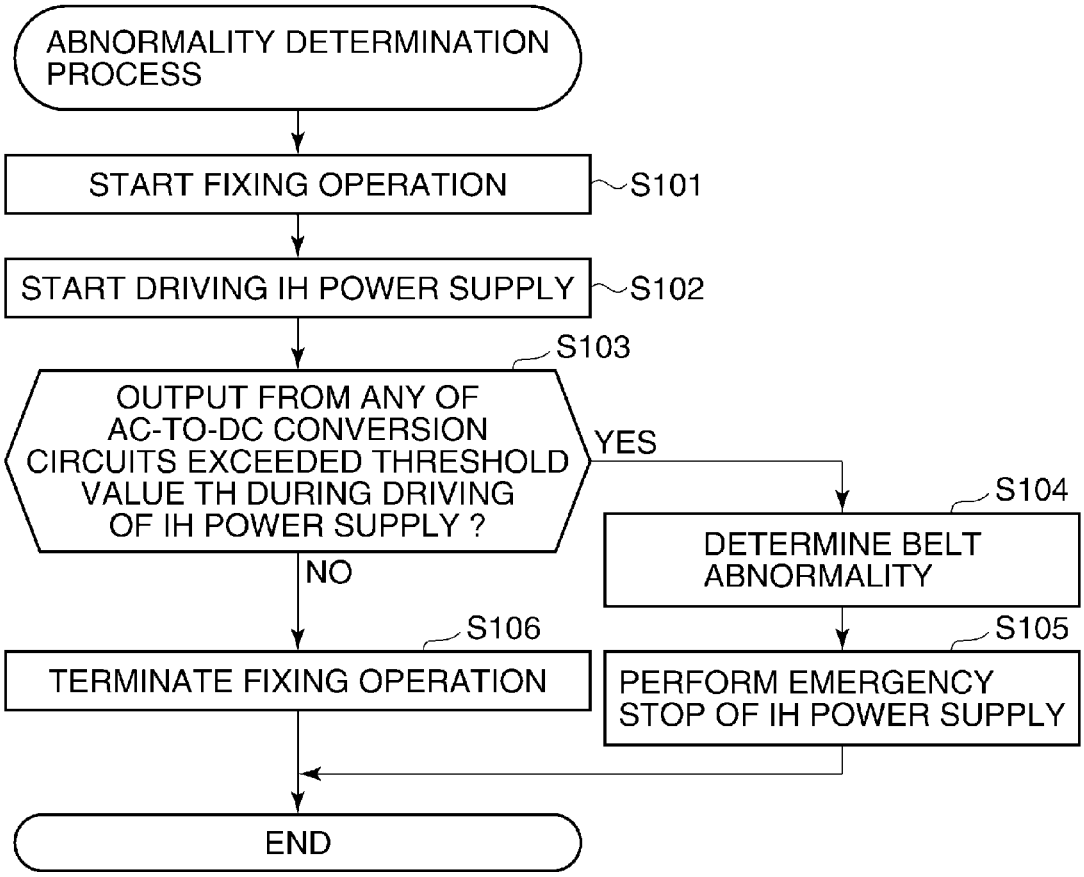
FIG. 11 is a flowchart of an abnormality determination process for determining abnormality of the fixing belt.

FIG. 11 is a flowchart of a process for determining abnormality of the fixing belt 120.

When the image forming apparatus 900 starts a print job, the control circuit 170 causes the fixing unit 911 to start a fixing operation (step S101). Next, the control circuit 170 starts driving the IH power supply 180 to thereby cause an AC current to flow through the induction heating coil 101 (step S102). More specifically, to raise the temperature of the fixing belt 120 to a temperature required for printing (e.g. 200° C.), the control circuit 170 performs induction heating during the print job.

Then, the control circuit 170 determines whether or not at least one of the output V1 from the first AC-to-DC conversion circuit 160 and the output V2 from the second AC-to-DC conversion circuit 168 has exceeded the reference threshold value TH during driving of the IH power supply 180 (step S103). More specifically, the control circuit 170 continues to monitor the outputs V1 and V2 while the IH power supply 180 is in operation for the fixing operation of the fixing unit 911. Then, the control circuit 170 determines whether or not at least one of the outputs V1 and V2 has exceeded the reference threshold value TH, before the induction heating for the fixing operation becomes unnecessary and the driving of the IH power supply 180 is stopped.

As a result of the determination, if at least one of the outputs V1 and V2 has exceeded the reference threshold value TH during the driving of the IH power supply 180, the control circuit 170 determines that the belt abnormality has occurred (step S104). In this case, the control circuit 170 performs emergency stop of driving of the IH power supply 180 to thereby stop supply of electric power to the induction heating coil 101 (step S105). The emergency stop of the IH power supply 180 makes it possible to prevent the fixing operation from being continued in an abnormal state. As a result, it is possible to improve safety by preventing occurrence of a further failure.

On the other hand, in the step S103, if the driving of the IH power supply 180 has been terminated with neither of the outputs V1 and V2 exceeding the reference threshold value TH, the control circuit 170 terminates the fixing operation (step S106). In this case, occurrence of the belt abnormality is not detected.

According to the present embodiment, the two antennas 140 and 141 each configured to have the polarity inverting portion R formed at an intermediate portion in the extending direction thereof are arranged parallel to each other such that they cover, in combination, the entire width of the fixing belt 120 while partially overlapping each other. The provision of the polarity inverting portions R makes it possible to obtain output even when the fixing belt 120 suffers from a small belt abnormality. This makes it easy to detect the small belt abnormality by setting a small reference threshold value TH. Further, the two antennas 140 and 141 are arranged such that the positions of the polarity inverting portions R thereof do not coincide with each other, and at the same time one of the antennas can detect magnetic flux at the position of the polarity inverting portion R of the other antenna. This enables the other antenna to detect the belt abnormality which occurs in an area extending equally in opposite directions from the polarity inverting portion R of the one antenna along the width of the fixing belt 120, so that it is possible to detect the belt abnormality at any position of the fixing belt 120. Therefore, it is possible to accurately determine a change in the state of the fixing belt 120, which occurs in a narrow region of the fixing belt 120.

Further, when the belt abnormality occurs, the driving of the IH power supply 180 is forcibly stopped. This makes it possible to avoid wasteful processing and improve safety.

In the above-described FIG. 11 process, after it is determined that the belt abnormality has occurred (step S104), there may be provided a step for roughly recognizing a place where the belt abnormality has occurred, according to which of the outputs V1 and V2 has exceeded the reference threshold value TH. For example, when only the output V1 has exceeded the reference threshold value TH, it is possible to determine that the belt abnormality has occurred in the area A, whereas when both the outputs V1 and V2 have exceeded the reference threshold value TH, it is possible to determine that the belt abnormality has occurred in the area B.

Since the reference threshold value TH is set so as to detect an imbalance of magnetic flux entering the first and second antennas 140 and 141, it is possible to set the reference threshold value TH according to the degree of belt abnormality which is desired to be detected. If the object thereof is to detect a smaller belt abnormality, it is possible to accurately detect the smaller belt abnormality by setting a smaller reference threshold value TH.

In the present embodiment, abnormality is detected by making use of the phenomenon that the state of magnetic flux entering the first and second antennas 140 and 141 is changed by the belt abnormality. However, insofar as the first and second antennas 140 and 141 are arranged at respective positions where abnormality of the fixing belt 120 can be detected by making use of the above-mentioned phenomenon, positions where the first and second antennas 140 and 141 are disposed, respectively, are by no means limited to the above-described positions inside the fixing belt 120.

More specifically, it is only required to arrange the first and second antennas 140 and 141 at respective positions where magnetic flux generated by the induction heating coil 101 can be detected assuming that at least the fixing belt 120 does not exist. Therefore, the first and second antennas 140 and 141 may be arranged outside the fixing belt 120.

Further, it is only required to arrange the first and second antennas 140 and 141 such that they are parallel to each other in the extending direction thereof and overlap each other at least in some area. A direction in which they overlap each other is not limited to the vertical direction, and they may be caused to overlap each other in whichever order. Furthermore, the extending direction of each of the first and second antennas 140 and 141 is not limited to be parallel to the direction of the width of the fixing belt 120. Although it is preferable that the first and second antennas 140 and 141 are opposed to each other such that they are parallel to the direction of the width of the fixing belt 120, this is not limitative, but they may be arranged in oblique relation to the direction of the width of the fixing belt 120 insofar as they are arranged such that magnetic flux can be detected.

Further, the positions of the polarity inverting portions R of the first and second antennas 140 and 141, and the manner of overlapping the first and second antennas 140 and 141 are not limited to those in the above-described embodiment. As illustrated in variations in FIGS. 12A to 12C, it is only required to arrange the first and second antennas 140 and 141 such that the positions of the polarity inverting portions R thereof are not coincident with each other, and at the same time one of the first and second antennas 140 and 141 can detect magnetic flux at the position of the polarity inverting portion R of the other antenna.

Figure 12A:
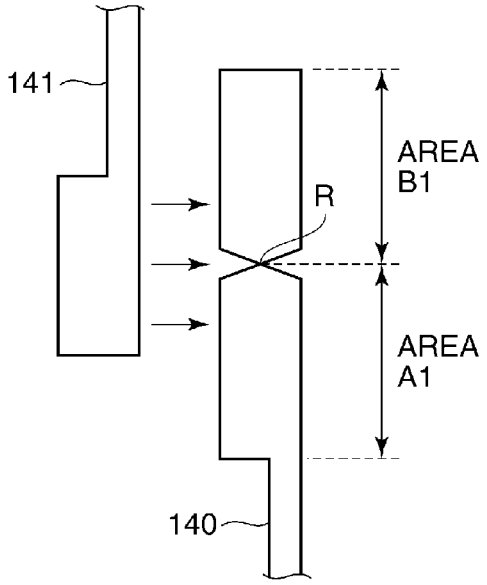
FIGS. 12A to 12C are schematic views of employable variations of the antennas.
Figure 12B:
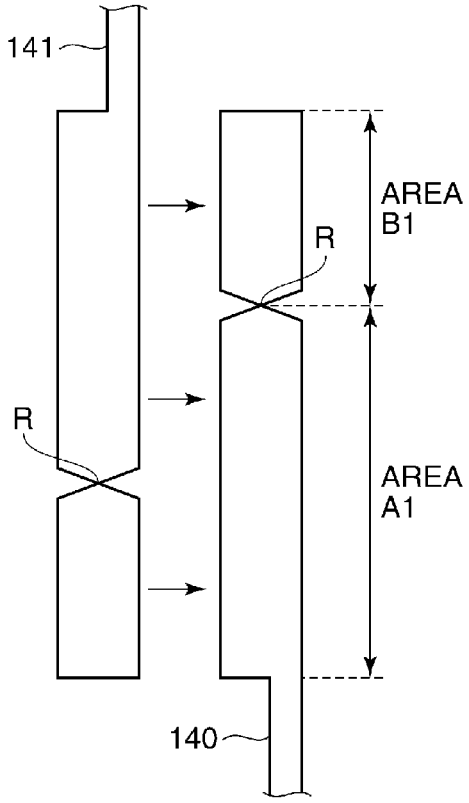
Figure 12C:
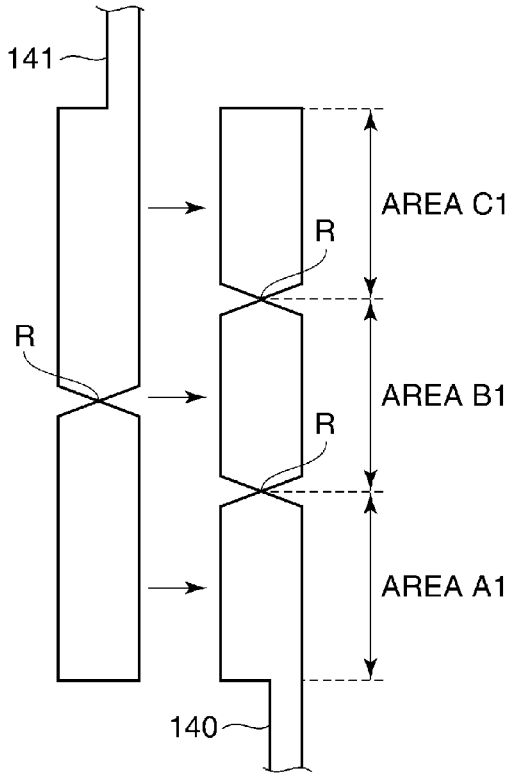
Figure 13:
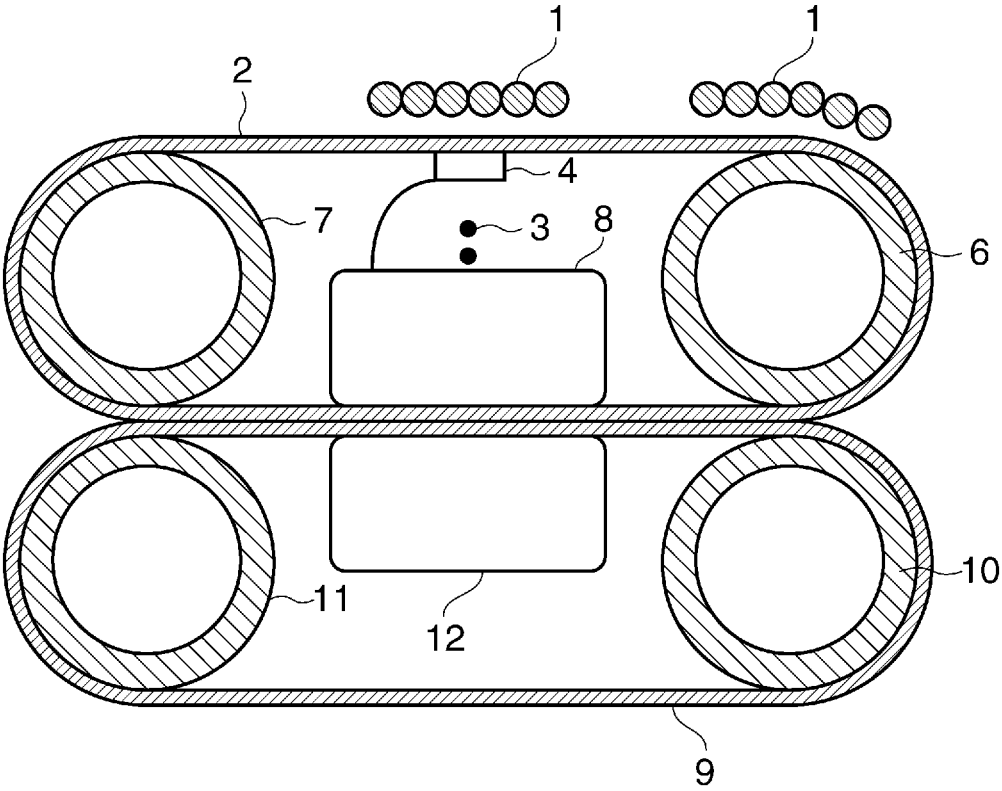
FIG. 13 RELATED ART
FIG. 13 is a schematic diagram of a fixing device for an image forming apparatus disclosed in Japanese Patent Laid-Open Publication No. 2007-328159.
Figure 14A:
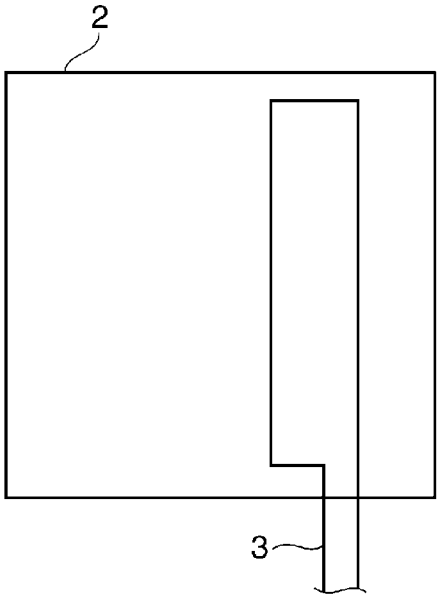
FIG. 14A RELATED ART
FIGS. 14A and 14B are schematic diagrams of conventional antennas.
Figure 14B:
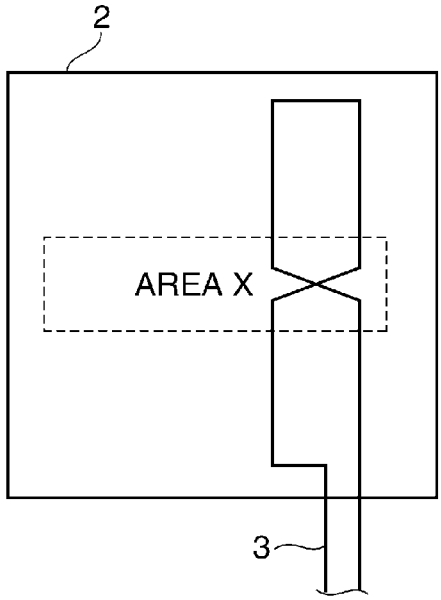
FIG. 14B RELATED ART

FIGS. 12A to 12C are schematic views of employable variations of the first and second antennas 140 and 141. Although in FIGS. 12A to 12C, similarly to FIG. 7A, top views of the first and second antennas 140 and 141 are shown separately, the first and second antennas 140 and 141 are arranged in the same overlapping manner as shown in FIG. 8 while maintaining the vertical positional relationship shown in FIGS. 12A to 12C.

As shown in FIG. 12A, the polarity inverting portion R may be formed only in one of the two antennas. In the illustrated example, only the first antenna 140 is formed with one polarity inverting portion R, but the second antenna 141 is not formed with any polarity inverting portion R. Further, an area A1 and an area B1 of the first antenna 140 correspond to an area over the entire width of the fixing belt 120. Belt abnormality at the position of the polarity inverting portion R of the first antenna 140 can be detected by the second antenna 141.

Further, as shown in FIG. 12B, the polarity inverting portions R may not be arranged in the respective central positions of the first and second antennas 140 and 141 in the extending direction thereof. Furthermore, the first and second antennas 140 and 141 may overlap each other in the whole areas thereof. In the illustrated example, the positions of the polarity inverting portions R of the first and second antennas 140 and 141 are displaced from each other. This makes it possible to detect the belt abnormality having occurred at the position of the polarity inverting portion R of the first antenna 140 by the second antenna 141, and the belt abnormality having occurred at the position of the polarity inverting portion R of the second antenna 141 by the first antenna 140.

Further, as shown in FIG. 12C, two or more polarity inverting portions R may be formed in one antenna. In the illustrated example, the first antenna 140 is formed with two polarity inverting portions R. In this example as well, since the positions of the polarity inverting portions R of the first and second antennas 140 and 141 are displaced from each other, it is possible to mutually compensate for detection of belt abnormality which occurs in an area extending equally from a polarity inverting portion R along the width of the belt where it is difficult to detect belt abnormality.

Also in the examples shown in FIGS. 12A to 12C, by comparing each of the individual outputs V1 and V2 with the reference threshold value TH, it is possible to finely estimate where belt abnormality has occurred.

It is to be understood that in the examples illustrated in FIGS. 7A and 7B and FIGS. 12A to 12C, the relationship between the first antenna 140 and the second antenna 141 may be inverted. Further, three or more antennas may be arranged parallel to each other, and at least one of the antennas may be formed with at least one polarity inverting portion R. In this case, it is only required to arrange the antennas such that belt abnormality can be detected in the area along the entire width of the fixing belt 120 by cooperation of two or more antennas.

Further, the construction of the "magnetic flux-detecting unit" for detecting magnetic flux is not limited to the first and second antennas 140 and 141, but the magnetic flux-detecting unit may be constructed using a hall element or the like. The manner of forming the polarity inverting portions R is not limited, either. The first and second antennas 140 and 141 may be each configured such that the difference between the magnetic fluxes passing through opposite sides of a boundary of the fixing belt 120 formed at an intermediate portion of the magnetic flux-detecting unit.

Further, the "to-be-heated member" as a target of which a change in state is to be determined is not limited to the fixing belt of a belt fixing type fixing device. For example, the to-be-heated member may be a fixing roller of a roller fixing type fixing device or a supporting member for supporting solid ink, in an ink jet printer. In this case, it is envisaged that a change in the state of the fixing roller or the supporting member corresponds to deformation, such as damage or distortion, of the fixing roller or the supporting member.

Although in the above-described embodiment, the present invention is applied to the fixing device for the image forming apparatus, this is not limitative, but the present invention can be applied to any device insofar as it is a heating device in which a to-be-heated member generates heat by electromagnetic induction. For example, the present invention can be applied to a heating device for a laminating process for forming a layered member by affixing thin layers of materials to each other.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims priority from Japanese Patent Application No. 2010-229568 filed Oct. 12, 2010, which is hereby incorporated by reference herein in its entirety.

What is claimed is:

1. A heating device comprising:

a coil that generates magnetic flux by flow of electric current therethrough;

a to-be-heated member configured to generate heat by action of the magnetic flux generated by said coil;

a first magnetic flux-detecting unit disposed at a location where said first magnetic flux-detecting unit is capable of detecting the magnetic flux generated by said coil assuming that said to-be-heated member does not exist;

a second magnetic flux-detecting unit disposed such that at least some area of said second magnetic flux-detecting unit overlaps said first magnetic flux-detecting unit; and a control unit configured to determine whether or not a state of said to-be-heated member has changed, based on a result of detection by said first magnetic flux-detecting unit and a result of detection by said second magnetic flux-detecting unit, wherein said first magnetic flux-detecting unit includes at least one polarity inverting portion as a boundary on opposite sides of which a polarity of output is inverted therebetween, and wherein said second magnetic flux-detecting unit includes a polarity inverting portion as a boundary at which on opposite sides of which a polarity of output is inverted therebetween, provided at a position that is not coincident with a position of said polarity inverting portion of said first magnetic flux-detecting unit.

2. The heating device according to claim 1, wherein said control unit determines that the state of said to-be-heated member has changed, in a case where at least one of the result of detection by said first magnetic flux-detecting unit and the result of detection by said second magnetic flux-detecting unit exceeds a reference threshold value.

3. The heating device according to claim 1, wherein said second magnetic flux-detecting unit includes at least one said polarity inverting portion, and said first magnetic flux-detecting unit is disposed such that said first magnetic flux-detecting unit is capable of detecting the magnetic flux at a position coincident with the position of said polarity inverting portion of said second magnetic flux-detecting unit.

4. The heating device according to claim 1, wherein said control unit stops supply of electric power to said coil when said control unit determines that the state of said to-be-heated member has changed.

5. The heating device according to claim 1, wherein said first and second magnetic flux-detecting units comprise respective antenna each formed of electric wire for generating voltage or current by magnetic flux, and at least one of said antennas, which includes said polarity inverting portion, is disposed such that the electric wire extends in a go-and-return manner in an extending direction thereof, and is provided with said polarity inverting portion by being twisted at intermediate portions thereof such that go and return lines thereof intersect each other.

6. A heating device comprising:

a coil that generates magnetic flux by flow of electric current therethrough;

a to-be-heated member configured to generate heat by action of the magnetic flux generated by said coil;

a first magnetic flux-detecting unit disposed at a location where said first magnetic flux-detecting unit is capable of detecting the magnetic flux generated by said coil assuming that said to-be-heated member does not exist;

a second magnetic flux-detecting unit disposed such that at least some area of said second magnetic flux-detecting unit overlaps said first magnetic flux-detecting unit; and a control unit configured to determine whether or not a state of said to-be-heated member has changed, based on a result of detection by said first magnetic flux-detecting unit and a result of detection by said second magnetic flux-detecting unit, wherein said first magnetic flux-detecting unit includes at least one polarity inverting portion as a boundary on opposite sides of which a polarity of output is inverted therebetween, and wherein said second magnetic flux-detecting unit includes no polarity inverting portion as a boundary on opposite sides of which a polarity of output is inverted therebetween, and is disposed at a position where said second magnetic flux-detecting unit is capable of detecting the magnetic flux at a position of said polarity inverting portion of said first magnetic flux-detecting unit.

7. An image forming apparatus comprising:

a transfer unit configured to transfer a toner image onto a recording medium;

a coil that generates magnetic flux by flow of electric current therethrough;

a fixing belt configured to generate heat by action of the magnetic flux generated by said coil, to thereby heat the toner image transferred onto the recording medium;

a first magnetic flux-detecting unit disposed at a location where said first magnetic flux-detecting unit is capable of detecting the magnetic flux generated by said coil assuming that said fixing belt does not exist;

a second magnetic flux-detecting unit disposed such that at least some area of said second magnetic flux-detecting unit overlaps said first magnetic flux-detecting unit; and a control unit configured to determine whether or not a state of said fixing belt has changed, based on a result of detection by said first magnetic flux-detecting unit and a result of detection by said second magnetic flux-detecting unit, wherein said first magnetic flux-detecting unit includes at least one polarity inverting portion as a boundary on opposite sides of which a polarity of output is inverted therebetween, and wherein said second magnetic flux-detecting unit includes a polarity inverting portion as a boundary on opposite sides of which a polarity of output is inverted therebetween, provided at a position that is not coincident with a position of said polarity inverting portion of said first magnetic flux-detecting unit.

8. An image forming apparatus comprising:

a transfer unit configured to transfer a toner image onto a recording medium;

a coil that generates magnetic flux by flow of electric current therethrough;

a fixing belt configured to generate heat by action of the magnetic flux generated by said coil, to thereby heat the toner image transferred onto the recording medium;

a first magnetic flux-detecting unit disposed at a location where said first magnetic flux-detecting unit is capable of detecting the magnetic flux generated by said coil can be detected assuming that said fixing belt does not exist;

a second magnetic flux-detecting unit disposed such that at least some area of said second magnetic flux-detecting unit overlaps said first magnetic flux-detecting unit; and a control unit configured to determine whether or not a state of fixing belt has changed, based on a result of detection by said first magnetic flux-detecting unit and a result of detection by said second magnetic flux-detecting unit, wherein said first magnetic flux-detecting unit includes at least one polarity inverting portion as a boundary on opposite sides of which a polarity of output is inverted therebetween, and wherein said second magnetic flux-detecting unit includes no polarity inverting portion as a boundary on opposite sides of which a polarity of output is inverted therebetween, and is disposed at a position where said second magnetic flux-detecting unit is capable of detecting the magnetic flux at a position of said polarity inverting portion of said first magnetic flux-detecting unit.

* * * * *